US008475014B2

(12) United States Patent
Jones et al.

(10) Patent No.: US 8,475,014 B2
(45) Date of Patent: Jul. 2, 2013

(54) T-BAR MOUNTING SYSTEM

(75) Inventors: Mark O. Jones, South Dartmouth, MA (US); Graham M. Rippel, Walpole, MA (US); Michael S. O'Boyle, South Dartmouth, MA (US); Craig S. Nevers, Warwick, RI (US)

(73) Assignee: Genlyte Thomas Group, LLC, Louisville, KY (US)

( * ) Notice: Subject to any disclaimer, the term of this patent is extended or adjusted under 35 U.S.C. 154(b) by 197 days.

(21) Appl. No.: 12/968,448

(22) Filed: Dec. 15, 2010

(65) Prior Publication Data

US 2011/0080750 A1 Apr. 7, 2011

Related U.S. Application Data

(63) Continuation of application No. 11/768,565, filed on Jun. 26, 2007, now Pat. No. 7,874,708.

(51) Int. Cl.
*F21V 21/04* (2006.01)
*F21S 8/02* (2006.01)

(52) U.S. Cl.
USPC ..... 362/365; 362/148; 362/430; 362/457; 248/220.22; 248/343

(58) Field of Classification Search
USPC ..... 362/147–150, 364–366, 368, 418, 362/430, 457; 248/200.1, 220.22, 342–344
See application file for complete search history.

(56) References Cited

U.S. PATENT DOCUMENTS

| | | | | |
|---|---|---|---|---|
| 3,397,499 | A * | 8/1968 | Ward | 52/777 |
| 3,612,461 | A | 10/1971 | Brown | |
| 3,816,880 | A | 6/1974 | Jacobs | |
| 4,232,361 | A | 11/1980 | Kelsall | |
| 4,277,641 | A | 7/1981 | Bauer | |
| 4,293,895 | A | 10/1981 | Kristofek | |
| 4,307,672 | A | 12/1981 | Shikimi | |
| 4,313,154 | A | 1/1982 | Capostagno | |
| 4,318,161 | A | 3/1982 | Shanks | |
| 4,318,162 | A | 3/1982 | Sip | |
| 4,335,511 | A | 6/1982 | Bowling | |
| 4,336,575 | A | 6/1982 | Gilman | |
| 4,345,381 | A | 8/1982 | Brislin | |
| 4,382,274 | A | 5/1983 | De Backer | |
| 4,388,677 | A | 6/1983 | Druffel | |
| 4,388,890 | A | 6/1983 | Wester | |
| 4,400,766 | A | 8/1983 | Munson | |
| 4,408,262 | A | 10/1983 | Kusmer | |
| 4,414,617 | A | 11/1983 | Galindo | |
| 4,419,717 | A | 12/1983 | Price | |
| 4,424,554 | A | 1/1984 | Woloski | |
| 4,431,151 | A | 2/1984 | Schonasky | |
| 4,450,512 | A | 5/1984 | Kristofek | |
| 4,459,429 | A | 7/1984 | Docimo | |
| 4,459,648 | A | 7/1984 | Ullman | |
| 4,471,416 | A | 9/1984 | Druffel | |
| 4,482,940 | A | 11/1984 | Brandherm | |
| 4,503,489 | A | 3/1985 | Duerr | |
| 4,510,559 | A | 4/1985 | Kristofek | |
| 4,522,541 | A | 6/1985 | Bidwell | |

(Continued)

*Primary Examiner* — Alan Cariaso

(57) ABSTRACT

A T-bar mounting bracket assembly for a luminaire fixture frame having a bracket, a clip vertically adjustable relative to the bracket, the clip extending through an opening in the bracket, a fastener extending through the bracket and the clip and, the fastener spaced from a location where the clip passes through the opening.

28 Claims, 15 Drawing Sheets

U.S. PATENT DOCUMENTS 4,582,737 A 4/1986 Torgerson
4,591,658 A 5/1986 Bauer
4,605,816 A 8/1986 Jorgensen
4,613,929 A 9/1986 Totten
4,619,086 A 10/1986 Naka
4,623,956 A 11/1986 Conti
4,646,212 A 2/1987 Florence
4,677,802 A 7/1987 Vukmanic
4,684,223 A 8/1987 Ikemori
4,704,664 A 11/1987 McNair
4,713,916 A 12/1987 Brooks
4,729,080 A 3/1988 Fremont
4,754,377 A 6/1988 Wenman
4,764,851 A 8/1988 Hartmann
4,785,603 A 11/1988 Platt
4,792,191 A 12/1988 Farmer
4,829,410 A 5/1989 Patel
4,887,196 A 12/1989 Brown
4,894,759 A 1/1990 Siems
4,910,651 A 3/1990 Montanez
4,972,339 A 11/1990 Gabrius
4,989,334 A 2/1991 DuBose
5,014,853 A 5/1991 Crockett
5,045,985 A 9/1991 Russo
5,068,772 A 11/1991 Shapiro
5,072,344 A 12/1991 Fabbri
5,075,831 A 12/1991 Stringer
5,077,650 A 12/1991 Cestari
5,094,359 A 3/1992 DeMars
5,103,762 A 4/1992 Long
5,110,038 A 5/1992 Pantisano
5,122,944 A 6/1992 Webb
5,124,901 A 6/1992 Sojka
5,130,914 A 7/1992 Bengochea
5,186,319 A 2/1993 Ting
5,222,800 A 6/1993 Chan
5,236,157 A 8/1993 Reggiani
5,291,381 A 3/1994 Price
5,314,148 A 5/1994 Jones
5,317,493 A 5/1994 Muller
5,373,431 A 12/1994 Hayman
5,377,088 A 12/1994 Lecluze
5,452,193 A 9/1995 Hinnefeld
5,457,617 A 10/1995 Chan
5,538,214 A 7/1996 Sinila
5,556,188 A 9/1996 Poppenheimer
5,564,815 A 10/1996 Littman
5,567,041 A 10/1996 Slocum
5,597,234 A 1/1997 Winkelhake
5,630,663 A 5/1997 Ling et al.
5,669,324 A 9/1997 Muir
5,672,004 A 9/1997 Schmidt
5,678,794 A 10/1997 Kump
5,707,143 A 1/1998 Hentz
5,725,302 A 3/1998 Sirkin
5,738,436 A 4/1998 Cummings
5,755,507 A 5/1998 Hucks
5,758,959 A 6/1998 Sieczkowski
5,777,857 A 7/1998 Degelmann
5,803,585 A 9/1998 Littman
5,823,664 A 10/1998 Demshki
5,826,970 A 10/1998 Keller
5,836,678 A 11/1998 Wright
5,857,766 A 1/1999 Sieczkowski
5,937,605 A 8/1999 Wendt
5,941,625 A 8/1999 Morand
5,951,151 A 9/1999 Doubeck
5,957,574 A 9/1999 Hentz
6,062,704 A 5/2000 Holder
6,079,852 A 6/2000 Kamaya
6,095,669 A 8/2000 Cho
6,095,671 A 8/2000 Hutain
6,098,825 A 8/2000 Kohnen
6,113,245 A 9/2000 Reinert
6,142,439 A 11/2000 Aramaki
6,145,798 A 11/2000 Janisse
6,220,728 B1 4/2001 Andrus
6,234,644 B1 5/2001 Kotovsky
6,270,238 B1 8/2001 Mendelsohn
6,343,873 B1 2/2002 Eberhard
6,364,510 B1 4/2002 Bernhart
6,375,338 B1 4/2002 Cummings
6,431,723 B1 8/2002 Schubert
6,505,960 B2 1/2003 Schubert
6,568,830 B2 5/2003 Yaphe
6,769,784 B2 8/2004 Yaphe
6,854,860 B2 2/2005 Plunk
7,118,254 B2 10/2006 Czech
7,234,674 B2 6/2007 Rippel

* cited by examiner

T-BAR MOUNTING SYSTEM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a luminaire mounting system. Specifically, the present invention relates to recessed luminaire fixture frame mounting system.

2. Description of the Related Art

In construction of buildings, it is known to install false or suspended ceilings beneath water pipes, heating ducts and electrical races in order to easily access such structures while concealing them from normal activity within a building or room. Typically, the false ceiling is formed of acoustical tiles or drywall tiles which are supported by a network of inverted T-shaped grid members. The T-grid members are supported from the building structure by a plurality of wires or stems and are typically formed of lightweight, small gauge sheet steel. Such construction minimizes the cost of the grid members, provides adequate structural support for the ceiling tiles, and allows adequate access to mechanicals.

In mounting light fixtures to the T-grid, various known light fixtures require the use of multiple tools in order to connect hanger bars to the inverted T-grid formed of a plurality of inverted T-bars. For example, current mounting systems have four mounting bar ends which must be attached to the inverted T-bar members by bending using pliers, adding wire, driving a screw into the T-bar or by snapping the hanger bars onto the T-grid and utilizing tools to adjust the height of the fixture relative to the acoustical tile ceiling members. Such activities are difficult in and of themselves, however, when working above the ceiling level on a ladder, the task is not only difficult, but may be unsafe. It would be desirable to design a fixture which is mountable in a T-grid system without the use of tools. It would also be desirable to decrease the number of connections necessary to install a recessed lighting system to an inverted T-grid system while allowing quick, consistent, stable installation.

Given the foregoing, it will be appreciated that a luminaire mounting assembly is needed which at least may overcome the aforementioned deficiencies.

SUMMARY OF THE INVENTION

A T-bar mounting system comprises a fixture frame for a luminaire, hanger bars connected to the frame for connection of the frame to a suspended ceiling, a bracket connecting ends of the hanger bars, the bracket having an upwardly extending portion with an adjustment aperture therein and, a clip releasably connected to the bracket for slidable adjustment through the adjustment aperture, wherein the bracket is positionable against an upper surface of a suspended ceiling tile and the clip is positionable against an upper portion of a suspended ceiling grid. The clip has a contact tab bearing against the suspended ceiling grid. The bracket has a locator tab for engagement of the suspended ceiling grid. The T-bar mounting system further comprises a fastener extending through the clip for releasable adjustment of the clip. The bracket having a foot, the foot inhibiting ceiling tile float.

A T-bar mounting bracket assembly for a luminaire fixture frame comprises a bracket, a clip vertically adjustable relative to the bracket, the clip extending through an opening in the bracket, a fastener extending through the bracket and the clip, the fastener spaced from a location where the clip passes through the opening. The T-bar mounting bracket assembly further comprises a space between the fastener and a lower portion of the clip for receiving a T-bar. The clip has a neck extending through the aperture and wherein tightening of the fastener causes the clip to wedge against the bracket. The T-bar mounting assembly further comprises locator tabs extending from the bracket. The T-bar mounting bracket assembly further comprises locator tabs extending from the bracket. The clip and the bracket having three points of contact with a T-bar grid member.

A T-bar mounting bracket assembly for a luminaire fixture frame comprises a bracket, a clip vertically adjustable relative to the bracket, a fastener extending through the bracket and the clip, the bracket having a foot inhibiting ceiling tile float.

A suspended ceiling mounting assembly comprises a bracket extending from a first hanger bar to a second hanger bar, a slot extending through the bracket, a clip adjustable through the slot and, a fastener engaging the slot and the clip, wherein a suspended ceiling member is captured between the bracket, the clip and the fastener, and wherein the bracket engages a suspended ceiling tile. The clip and the bracket defining three points of contact with a suspended ceiling member. The suspended ceiling mounting assembly further comprises a hand tightenable nut. The suspended ceiling mounting assembly the nut being a wing nut. The suspended ceiling mounting assembly further comprises a knob, the knob being spring loaded. The assembly allows a tool-less installation between the bracket, the clip and a suspended ceiling member. The suspended ceiling mounting assembly further comprises a foot extending from the bracket for inhibiting ceiling tile float.

A suspended ceiling mounting assembly, comprises a first U-shaped sub-assembly comprising a first bracket, a first hanger bar, and a second hanger bar, a second U-shaped sub-assembly comprising a second bracket, a third hanger bar and a fourth hanger bar, a fixture frame disposed between the first U-shaped sub-assembly and said second U-shaped sub-assembly, the first U-shaped sub-assembly slidably connected to the second U-shaped sub-assembly and capturing the fixture frame there between. The suspended ceiling mounting assembly of Claim 21 further comprising an interference feature disposed between said first hanger bar and said third hanger bar for inhibiting said first U-shaped sub-assembly and said second U-shaped sub-assembly from disengaging. The suspended ceiling mounting assembly further comprising a clip slidably positioned on each of the first bracket and the second bracket, the clip receiving a T-bar between each of the clip and the first and second brackets. The suspended ceiling mounting assembly the clip being a hand tightenable nut. The suspended ceiling mounting assembly further comprising a releasably biased knob.

A recessed light mounting assembly comprises a first bracket assembly and a second bracket assembly, a first hanger bar assembly and a second hanger bar assembly connecting the first and second bracket assemblies, the first hanger bar assembly having a single connection to a T-bar grid, the second hanger bar assembly having a single connection to the T-bar grid.

A recessed light mounting assembly comprises a first bracket assembly and a second bracket assembly, a first hanger bar assembly and a second hanger bar assembly, the first and second hanger bar assemblies slidably connecting the first and second bracket assemblies, a frame slidably positioned on the first and second hanger bar assemblies between the first bracket assembly and the second bracket assembly, wherein the recessed light mounting assembly is connected to a T-bar grid at a first location by the first bracket assembly and at a second location by the second bracket assembly only.

A T-bar mounting bracket for use with a recessed lighting fixture frame, comprises a bracket, an upstanding portion extending from the bracket and being offset from a center of the bracket.

A recessed lighting mounting bracket for a suspended ceiling, comprises a bracket having a first end and a second end, the bracket having a substantially vertical adjustment slot, the slot being substantially offset from a center of the bracket between the first end and the second end.

A recessed lighting mounting assembly comprises a T-bar, a first bracket assembly connected to the T-bar, the first bracket having a first end, an opposed second end and an upstanding portion, the first bracket assembly connected to the T-bar, a second bracket assembly connected to the T-bar, the second bracket assembly having a first end, an opposed second end and an upstanding portion, each of the upstanding portion of the first and second bracket assemblies being offset from a center between the first end and a the second end, wherein the offset inhibits one of the first bracket assembly and second bracket assembly from interfering with the other of the first bracket assembly and the second bracket assembly.

A recessed light mounting bracket, comprises a bracket having a first end and a second end, at least one joist tab integrally formed on the bracket, the joist tab spacing the bracket from a lower edge of a joist to accommodate strapping extending between the joists.

A recessed light mounting assembly comprises a first bracket and a second bracket, first and second hanger bar assemblies extending between the first and second brackets, a first tab and a second tab movably connected to each of the first and second brackets, the first and second tabs lowering the first and second brackets relative to ceiling joists to accommodate strapping extending between the ceiling joists.

A recessed lighting bracket for joist structures comprises a bracket having a first end and a second end, a first tab and a second tab integrally formed on the bracket, the first and second tabs foldable relative to the bracket and spacing the bracket downwardly relative to the joist structures.

A recessed light mounting assembly, comprises a frame having an opening for receiving at least one hanger bar assembly, the at least one hanger bar assembly having a discontinuous surface, the opening having a rolled edge eyelet, wherein the frame slides relative to the at least one hanger bar assembly and wherein first and second hanger bars defining the at least one hanger bar assembly slide relative to one another.

A recessed light mounting assembly comprises a frame having a finger, the finger having an opening for slidably positioning a hanger bar assembly, the hanger bar assembly comprises a first hanger bar slidably receiving a second hanger bar, the opening having a rolled edge defining an eyelet providing smooth sliding of the frame relative to the hanger bar assembly.

A recessed light mounting assembly, comprises a frame including an aperture for slidably receiving a hanger bar assembly, the hanger bar assembly having a first hanger bar and a second hanger bar slidably positioned relative to the first hanger bar, a discontinuous surface defined where the first hanger bar and second hanger bar engage, the aperture having a rolled edge and providing a smooth sliding surface for the hanger bar assembly relative to the frame.

A trim mounting mechanism, comprises a frame having a rigid member pivotally connected thereto, at least one barb near an end of the rigid member, an aperture in the frame for receiving a trim member, the rigid members in a first position extending into the aperture and the at least one barb engaging the trim member, the rigid member pivoting with rotation of the trim member to a second position to disengage the trim member.

A trim mounting mechanism comprises a frame having an aperture for receiving a trim member, a grip extending into the aperture and engaging a trim member, the grip pivotally connected to the frame for movement between a first position engaging the trim member and a second position disengaging the trim member.

Trim mounting mechanism comprises a trim member engaged by a trim spring, the trim spring pivotally connected to a frame adjacent an aperture in the frame, the trim spring extending into the aperture for frictional engagement of with the trim member, the frictional engagement causing pivoting of the trim spring for disengagement of the trim member when the trim member is rotated for removal from the frame. The trim mounting mechanism further comprises a plurality of at least one tooth at an end of the trim spring for frictionally engaging the trim member.

BRIEF DESCRIPTION OF THE DRAWINGS

The above-mentioned and other features and advantages of this device, and the manner of attaining them, will become more apparent and the invention will be better understood by reference to the following description of embodiments of the device taken in conjunction with the accompanying drawings, wherein.

DETAILED DESCRIPTION

Figure 1:
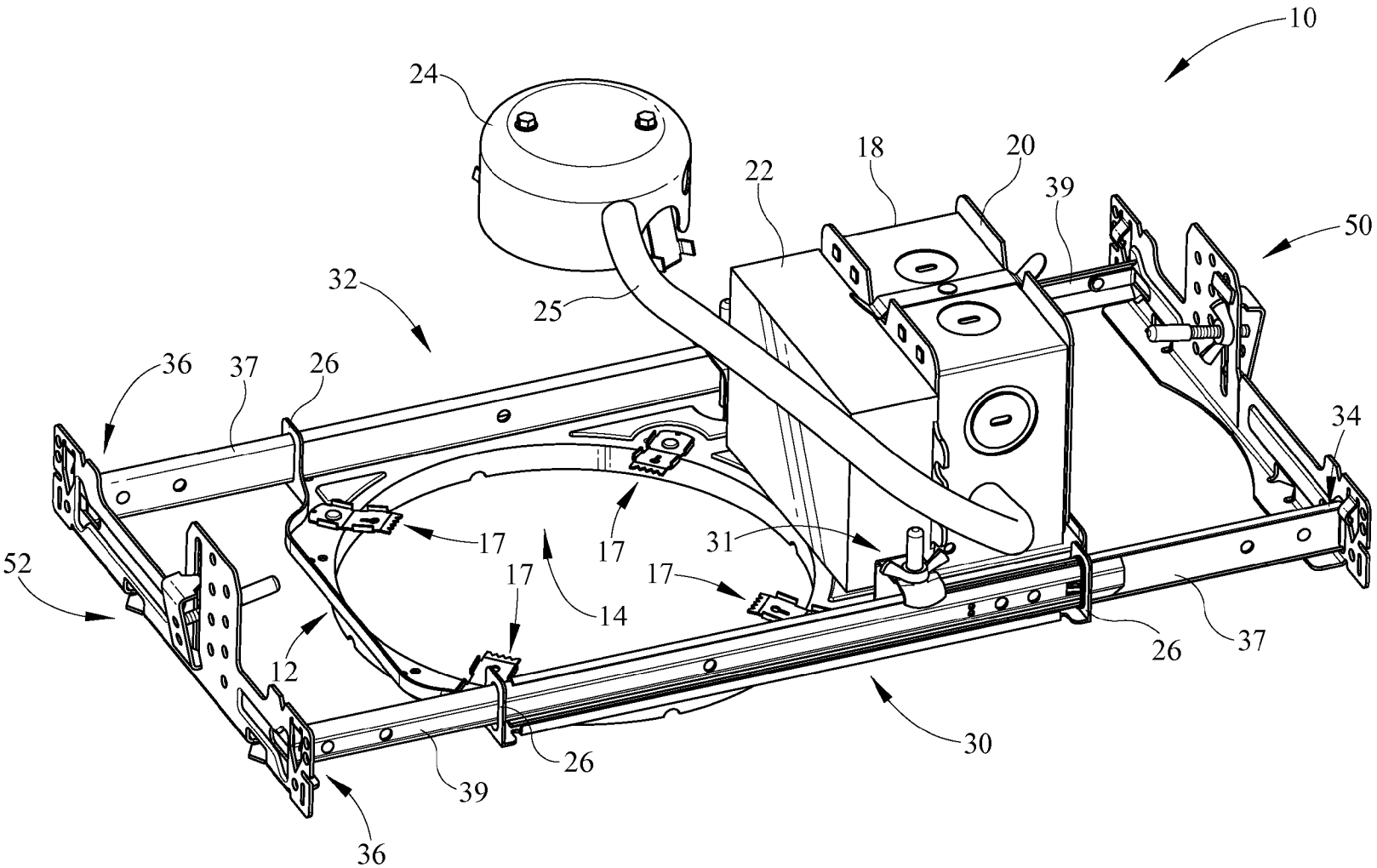
FIG. 1 is a perspective view of a T-bar mounting assembly for a luminaire fixture.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and other alternative mechanical configurations are possible.

Referring now to FIG. 1, a perspective view of the luminaire fixture assembly 10 is depicted. The luminaire fixture assembly 10 generally comprises a fixture frame 12 interposed between a first hanger bar assembly 30 and a second hanger bar assembly 32. The fixture frame 12 generally comprises a pan structure having an aperture 14 for receiving a reflector and lamp assembly (not shown). The fixture frame 12 is depicted as generally centrally positioned between the hanger bar assemblies 30, 32 but may be offset between the assemblies 30, 32. Further, the frame 12 may be positioned centrally between bracket assemblies 50, 52 or offset toward either side. The exemplary fixture frame 12 is generally flat and includes a mounting surface 16 upon which a junction box 18 positioned. However, one skilled in the art should realize that various alternative fixture frames could be utilized, in combination with hanger bar assemblies, such as the exemplary assemblies 30, 32, to mount the frame within a suspended ceiling or other ceiling support structure. Likewise, various types of junction boxes may be utilized which may vary in shape and size according to the need of the designer and the space requirements therein. For example, the fixture frame 12 and junction box 18 may be formed from a single blank of metal.

Extending from the peripheral edge of the aperture 14 are a plurality of reflector or trim grips 17 which engage a reflector positioned in the aperture 14. Each grip 17 has a plurality of teeth for engaging a reflector (not shown). The trim may include, for example, downlight or wall wash reflectors. Likewise the trim may be utilized with lenses such as specular clear, clear diffuse or matte white finishes. The grips 17 pivot at the fastener connection to the frame 12 so that in the position shown the teeth of the grips 17 catch the reflector. However, by rotating the reflector the grips 17 rotate at the fastener until they disengage the reflector allowing removal of the reflector and access to structure above the ceiling.

The junction box 18 has a door 20 for accessing the interior portion of the box 18 and making wiring connections therein between lamp wiring extending from a socket cup 24 and the power source wiring entering the junction box 18. Mounted opposite the door 20 on the junction box 18 is control device 22, such as ballast. The ballast limits the flow of current in an electrical circuit, in this instance the lighting circuit, to limit current to an appropriate level. The control device 22 is shown connected directly to the junction box 18 such that wiring from the device 22 extending through the junction box wall may be in electrical communication with power source wiring as well as wiring extending to the socket cup 24. However, the control device 22 may be spaced from the junction box 18 and wiring from the control device 22 may extend through a knock-out in the junction box 18 if such design is preferred. Alternatively, other types of control devices 22 may or may not be utilized. In the scenario where a control device is used, a dimming ballast, a transformer, an LED driver or other known control device may be utilized. Additionally, a battery back-up and charging circuit may be utilized on the junction box 18 or spaced therefrom. The socket cup 24 may house a lamp socket for mounting a lamp. With a lamp (not shown) extending from the socket cup 24, the lamp and socket cup 24 are positioned over the reflector (not shown) so that the lamp is positioned within the reflector and within the aperture 14.

Extending from the fixture frame 12 are a plurality of hanger bar receiving fingers 26 spaced about the fixture frame 12. The fingers 26 are exemplary as other brackets, struts, clamps or similar retaining structure may be utilized to connect the frame 12 and hanger bar assemblies 30, 32. Each of the exemplary fingers 26 defines an aperture which receives a hanger bar assembly 30, 32. According to the present design, the fingers 26 allow for sliding movement between the bracket assemblies 50, 52. Apertures located in the fingers 26 utilize an eyeleting technique to provide smooth movement between the hanger bar assemblies 30, 32 and fingers 26. In addition, the hanger bars 30, 32 utilize roll-formed edges which, in combination with the apertures in fingers 26, provide the desirable sliding motion without sticking and without cutting the installer. According to the present embodiment, the hanger bar assemblies 30,32 may be adjusted for use in 16 inch on-center wood joists up to 24 inch on-center T-bar, although the fixture may be designed for alternative spacing.

Since the frame 12 is slidable relative to the anger bar assemblies 30, 32, at least one brake 31 is provided. Various brake designs may be utilized, however, the exemplary embodiment utilizes a threaded stud connected to frame 12 which extends through a brake clamp. A nut is fastened to the stud and above the brake clamp so as to force the clamp into engagement with the hanger bar assemblies 30,32. As the nut is tightened, the clamp engages the hanger bar assemblies 30,32 locking the frame 12 relative to the hanger bars assemblies 30,32. A brake 31 may be used on each hanger bar assembly 30,32, although one of the brakes 31 is not shown in FIG. 1.

The first hanger bar assembly 30 and the second hanger bar assembly 32 each comprise a first end 34 and a second end 36. In prior art devices, the ends 34, 36 of hanger bar assemblies 30, 32 are connected to T-bar structure or other such ceiling support structure. Such connection typically requires four connections, each requiring tools to perform such activity. The bracket assemblies 50, 52 are disposed at ends 34, 36 of the hanger bar assemblies 30, 32 and will be described further herein. Each of the hanger bar assemblies 30, 32 comprises at least one hanger bar extending through the fingers 26. In the exemplary embodiment, first and second hanger bars 37, 39 are utilized to define each hanger bar assembly 30, 32. The first hanger bar 37 slides relative to the second hanger bar 39 so that the hanger bar assemblies 30, 32 may be utilized within T-bar grids, joists or other types of ceiling support systems which may vary in length between members. The hanger bars 37,39 utilized roll-formed edges. In the exemplary embodiment, each bracket 51, 53 includes two hanger bars 37, 39 extending therefrom and defining a U-shaped sub-structure. When the two sub-structures are connected by slidably connecting the opposed bars 37, 39 and through fingers 26, the pan 12 is held captive between the bracket assemblies 50, 52.

Figure 2:
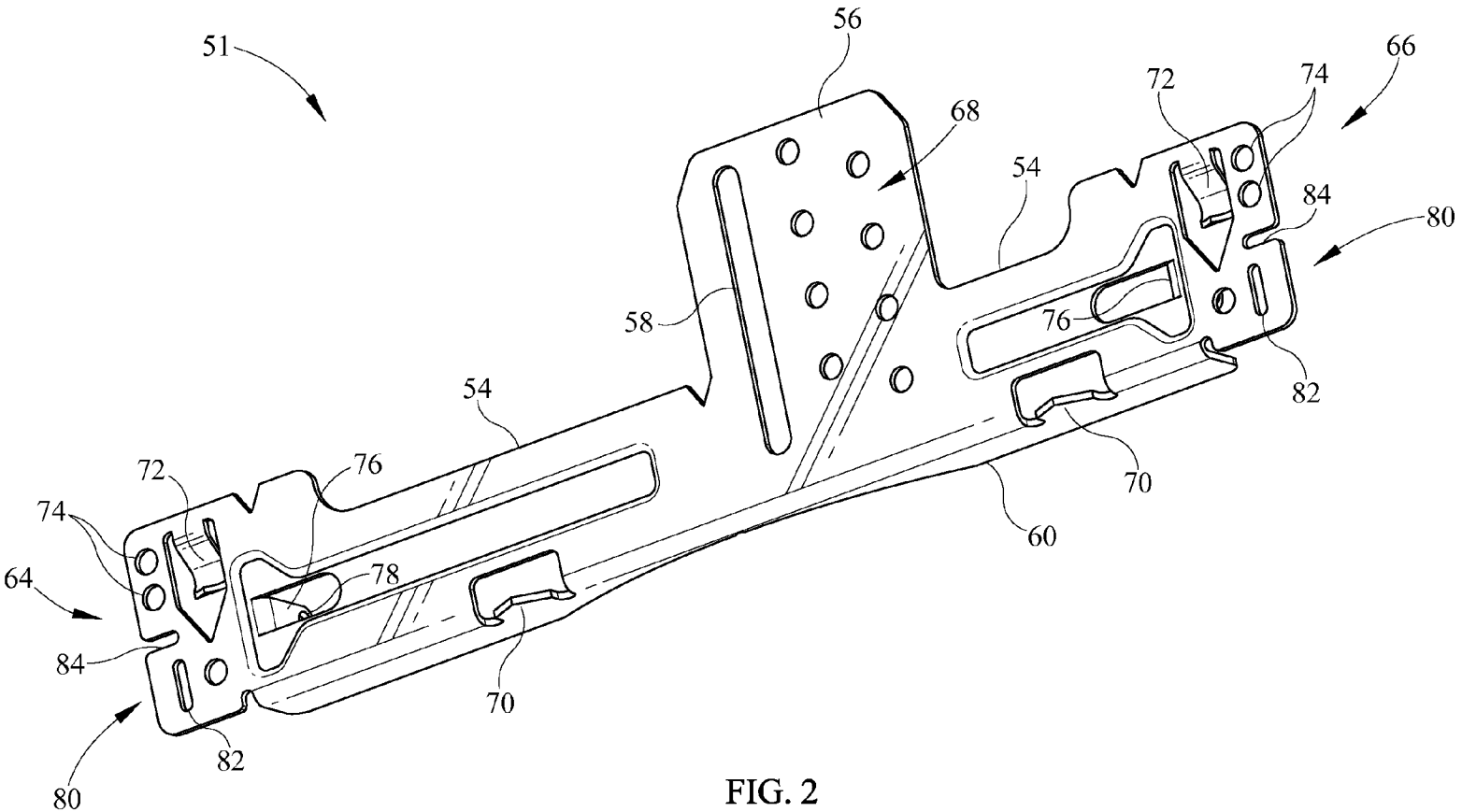
FIG. 2 is a perspective view of a first side of a bracket of the assembly of FIG. 1.
Figure 3:
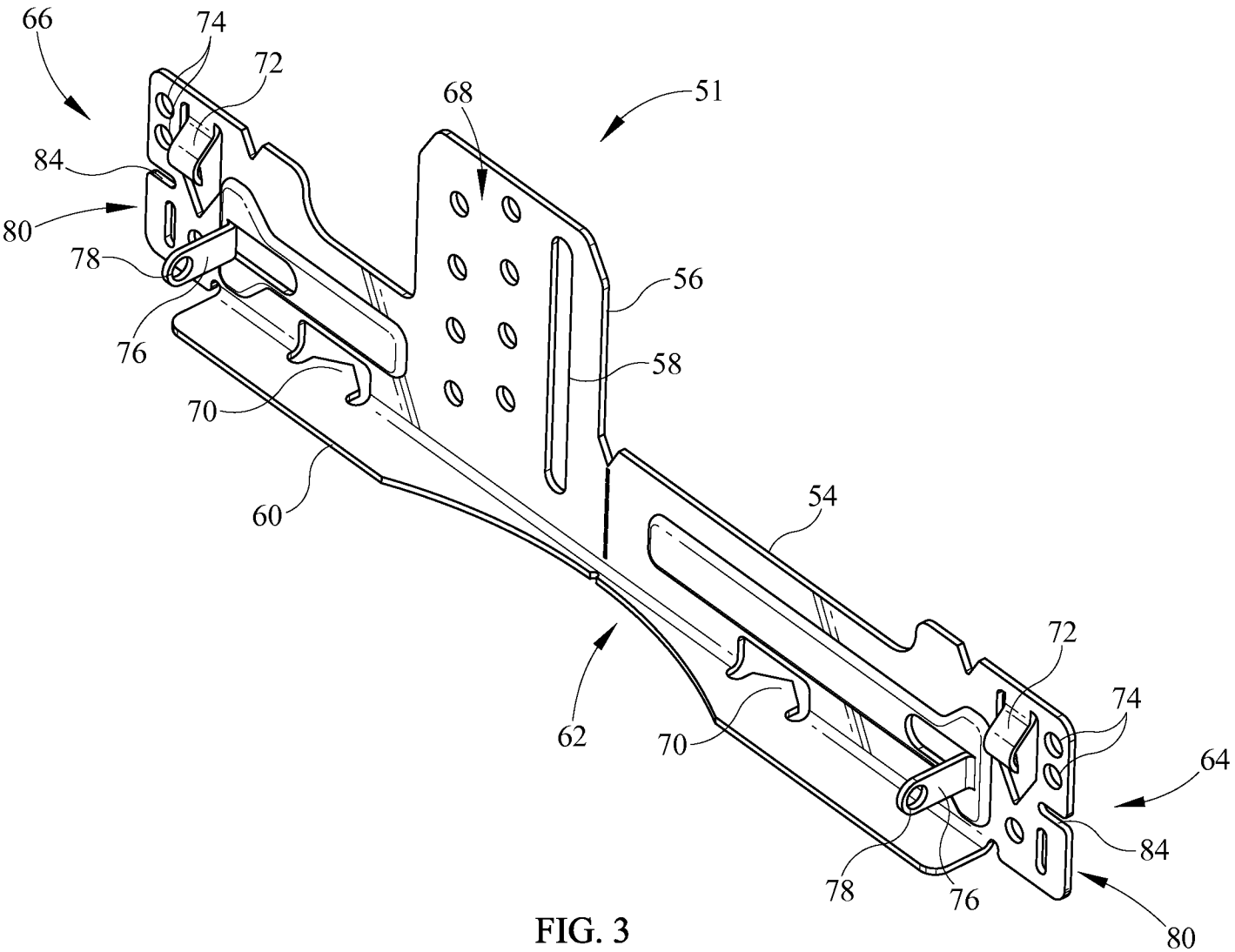
FIG. 3 is a second side of the bracket of FIG. 2.
Figure 4:
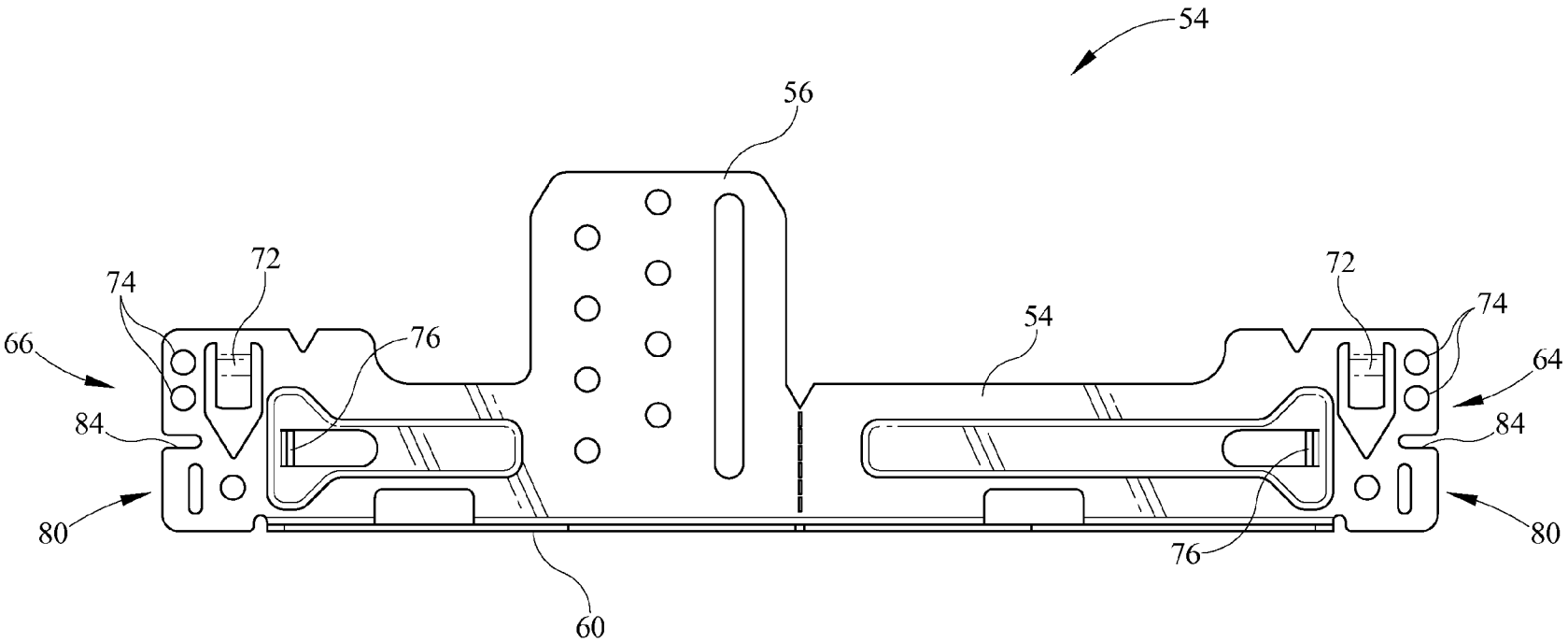
FIG. 4 is a side view of the bracket of FIG. 2.

Referring now to FIGS. 2, 3 and 4, various views of the bracket assemblies 50, 52 are depicted in various views. More specifically, brackets 51, 53 are shown which define portions of the assemblies 50, 52. The figures depict bracket 51 for purpose of clarity. However, it should be understood by one skilled in the art that the opposite bracket 53 is formed of the same elements but is removed merely for clarity of description. The bracket 51 comprises a substantially horizontal bar 54 having a first end 64 and a second end 66. The generally horizontal bar 54 as sized to extend from one of the hanger bar assemblies 30, 32 to the other of the hanger bar assemblies 30, 32.

Figure 14:
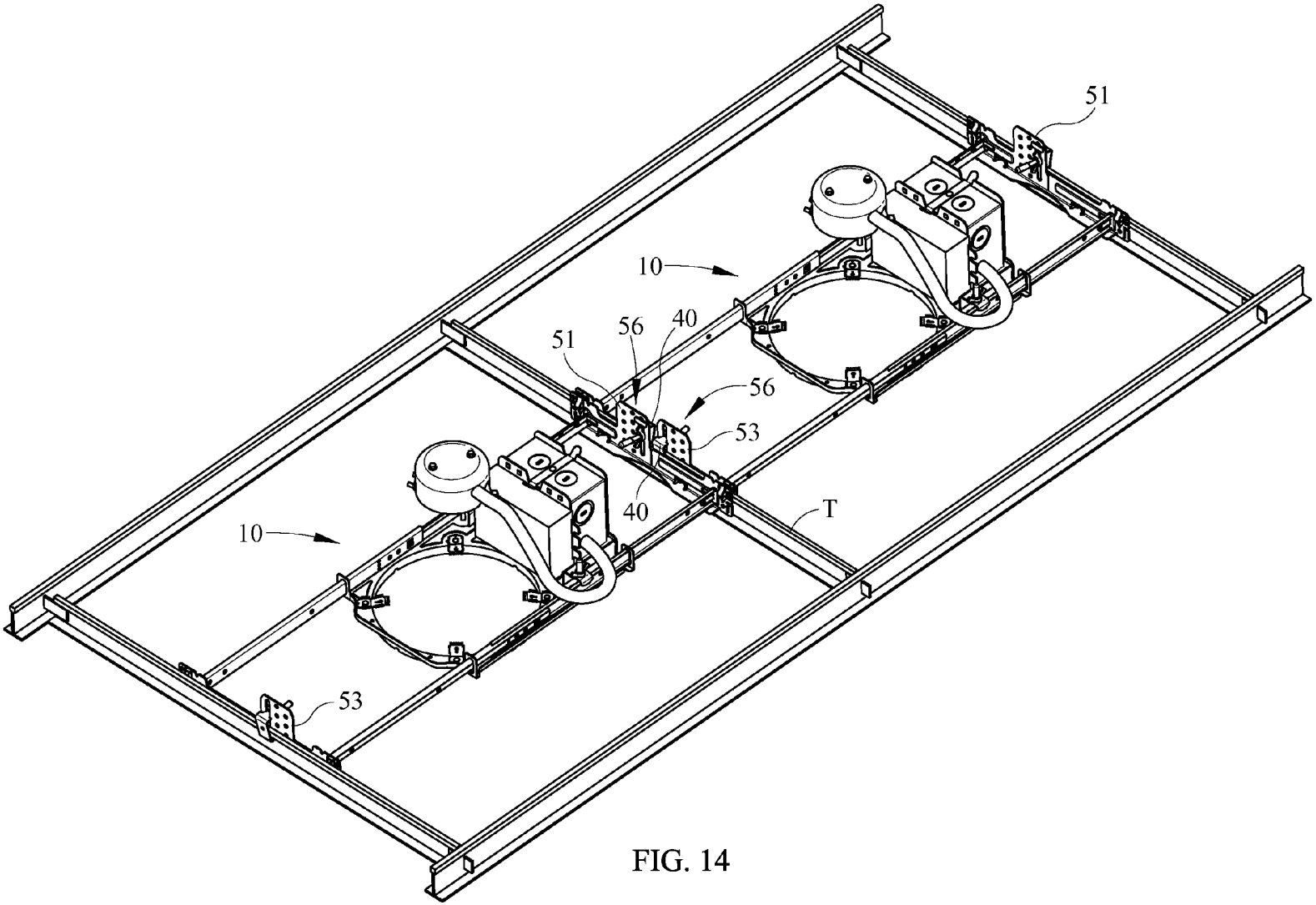
FIG. 14 is a perspective view of two fixture frames arranged end-to-end.

Each bracket 51 further comprises an upstanding portion 56. The exemplary upstanding portion 56 extends substantially perpendicular to the bar 54 and further comprises a plurality of holes 68. The holes or apertures 68 allow for alternate mounting options or for pass-through of alternate fastening hardware. The exemplary upstanding portion 56 is generally vertically extending with respect to the bracket 51. The upstanding portion 56 is offset from the center of the bracket 51 so that when two fixture assemblies 10 are placed end to end in adjacent ceiling tiles or panels, the elements of one upstanding portion 56 will not interfere with the adjustment elements of the adjacent bracket 51. Likewise, where the slot 58 is disposed within the bracket but without an upstanding portion, the slot 58 is offset from the center bracket 51 so that the slots 58 are not aligned and will not interfere with the adjustment elements of the adjacent bracket. The term offset should be understood as referencing a substantially vertical axis extending through the bracket 51. The upstanding portions 56 are offset at least enough that slots 58 are not aligned, although the upstanding portions 56 may be offset more. As shown in FIG. 14, two assemblies 10 are positioned in an end-to-end arrangement. With the upstanding portions 56 and slots 58 offset from center, the clips 40 of the bracket assemblies 50,52 are each accessible for positioning over the T-bar member T. Further, the clips 40 do not interfere with one another during installation, tightening or while in-service.

As mentioned briefly previously, an adjustment slot 58 is positioned within the bracket 51. The adjustment slot 58 is substantially vertically oriented and extends upwardly from the bracket 51 through the upstanding portion 56. However, it should be understood that the slot 58 may be positioned completely within the bracket 51 if the bar bracket 51 is sized in a vertical dimension to completely encompass the slot 58.

Figure 9:
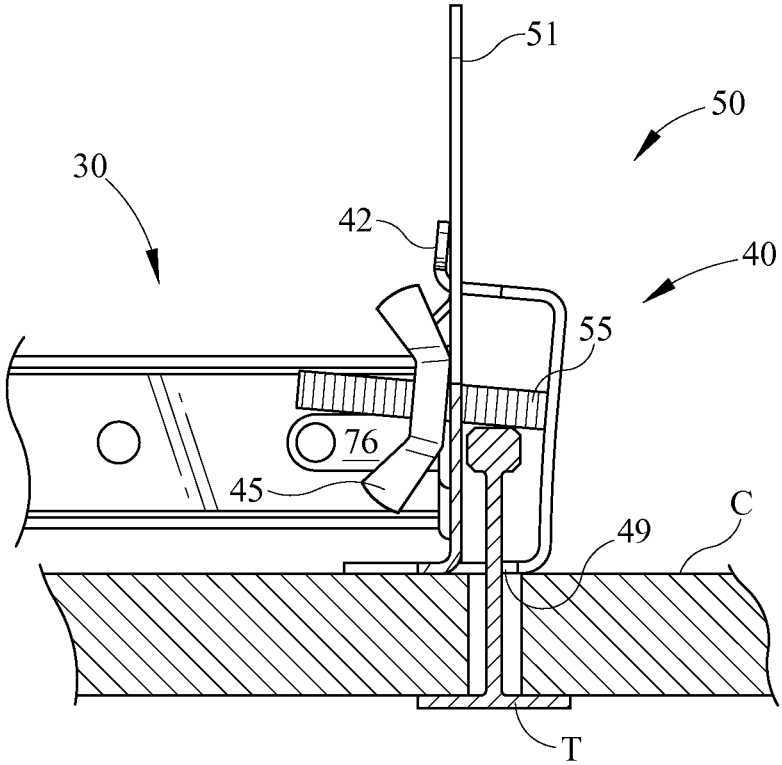
FIG. 9 is a second sequence of attaching the bracket assembly to a T-grid member.

Still referring to FIGS. 2, 3 and 4, the lower edge of the bracket 51 includes a foot 60 extending therefrom. The foot 60 is generally horizontal having an upper surface and a lower surface. One function of the foot 60 is to retain a ceiling tile within the ceiling grid defined by the plurality of T-bars T (FIG. 9). This retaining function inhibits upward the float during trim installation. The foot 60 also has a radiused cutout portion 62 which provides a space for positioning of an aperture ring or fixture frame incorporating a substantially circular aperture ring portion of a light fixture. Accordingly, the aperture ring or frame element can be moved to either side of the assembly in order to position the fixture adjacent to a joist or T-bar grid member.

During installation in a T-grid, the foot 60 may be positioned on an upper surface of a ceiling tile such that the aperture 14 is properly positioned relative to the tile opening. With the foot 60 is positioned against the upper surface of the ceiling tile, clips 40 are raised to a height above the top of the T-bars and the clips 40 are pulled away from one another so that the brackets 51,53 move outwardly toward the T-bars T (FIG. 9). Once the clips 40 clear the T-bars, the clips 40 may be lowered by sliding the clips 40 through the slot 58. Once the clips 40 pass over the T-bar heads, the bracket assemblies 50,52 are properly positioned for hand tightening so that the clip 40 engages the head of the t-grid member. As one skilled in the art will realize, the present mounting system allows for tool-free installation in a suspended ceiling and hand tightening at two locations rather than four locations as typical with prior art devices. This reduces installation time while providing quick, consistent and stable installation at each location a recessed light is desired. According to the design allowing for two points of connection, the fixture may be easily unlocked, repositioned and locked again for adjustment.

The bracket 51 further comprises locator tabs 70 at lower positions on the bracket 51. The locator tabs 70 extend horizontally in the plane of the foot 60 at two positions. The locator tabs 70 each have a point which is generally equivalent in shape to a contact tab 49 of the clip 40. The locator tabs 70 contact a portion of the T-bar opposite the contact tab 49 of the clip 40. Alternatively, the locator tabs 70 may be positioned against a lower surface of ceiling joists when the bracket 51 is utilized in such an alternative construction.

Likewise, the bracket is easily adjustable for use with wooden joists. For example, nailing tabs 72 may be hammered or struck so as to engage a wood joist or wood ceiling structure. The nailing tabs 72 provide a sharp initial engagement feature for the bracket 51 to engage a wood joist. From this position the opposite bracket 53 is extended to the opposite joist wherein a fastener may be positioned through the bracket 53 into the joist. Fastener holes 74, adjacent each nailing tab 72, allow for permanent connection of the bracket 51 to a joist. Screws, nails or other such fasteners may be utilized with the fastener hole 74 in order to attach the bracket 51 to a joist or other such ceiling structure.

Extending from the bracket 51 are arms 76. Hanger bar assemblies 30, 32 connect to the bracket assemblies 50, 52 at the arms 76. Each arm 76 has an aperture 78 which allows for connection of the arms 76 and the hanger bar assemblies 30, 32 by use of a fastener or the like. However, other engagement structures may be utilized to connect the bracket assemblies 50, 52 to the first and second hanger bar assemblies 30, 32.

The brackets 51 further comprise joist tabs 80. The tabs 80 fold at or adjacent to a slot 82 so that an upper edge 84 may be positioned against a lower horizontal surface of a joist. This lowers the bracket assemblies 50, 52 relative to the joists and positions the brackets 51 lower relative to the joists than when the locator tabs 70 are utilized. Such construction may be useful when straps extend between joists along the bottom surfaces of the joists which, in turn, lowers the ceiling by the thickness of the straps. Thus, the tabs 80 may have a vertical dimension equal to the thickness of a joist strap.

Figure 5:
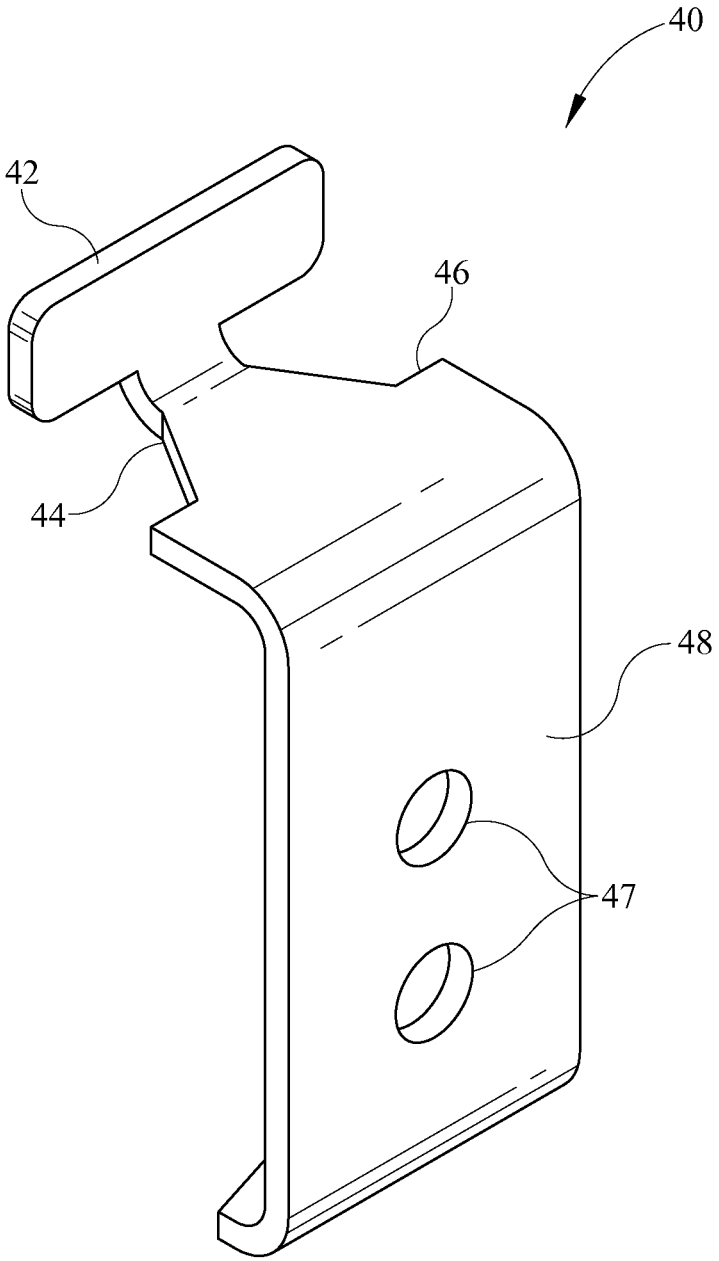
FIG. 5 is a perspective view of the clip of the assembly of FIG. 1.
Figure 6:
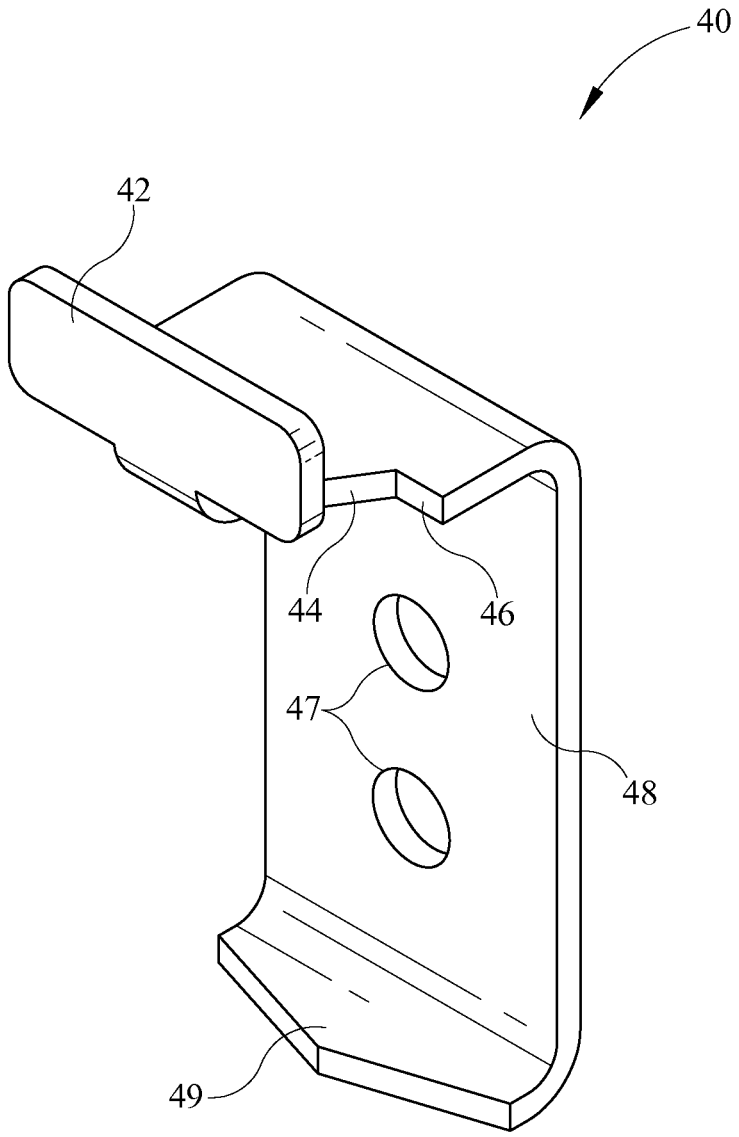
FIG. 6 is an opposite perspective view of the clip of the assembly of FIG. 1.

Referring now to FIGS. 5 and 6, perspective views of a clip 40 are depicted. The clip 40 comprises a head 42 which is generally rectangular in shape, although various alternative shapes may be utilized. The head 42 may have a width which is greater than the width of the slot 58 in the upstanding portion 24. The clip 40 is rotated so that the head 42 may be positioned through the slot 58. Once the had 42 passes through the slot 58, the clip 40 is rotated into a substantially vertical orientation, shown in FIGS. 5-7, so that the clip 40 ma not be pulled from the slot 58 and so that the clip 40 slides relative to the bracket 51 through slot 58. Adjustment of the clip 40 through the slot 58 provides usability with T-grid members or T-bars of various dimensions and further allows adjustability for ceiling tiles of various thicknesses. The clip 40 further comprises a neck 44 and a shoulder 46. The neck 44 extends from the head 42 toward the shoulder 46 so that one of the neck 44 or the shoulder 46 engages the bracket 51 as the clip 40 is tightened against the bracket 51. Specifically, the neck 44 of the exemplary design wedges into the slot 58 as the clip 40 is tightened against the bracket 51. This inhibits vertical the clip relative to the bracket 51. The clip 40 comprises a body 48 extending from the shoulder 46. The exemplary body 48 is substantially U-shaped and comprises at least one aperture 47. The exemplary design may include two apertures as shown in the Figures. A bolt or screw or other fastener 55 may extend through one of the apertures 47 to allow for tightening of the clip 40. Alternatively, the fastener 55 may be welded to, or otherwise integral with, the clip 40 so as to extend through the bracket 51. At a lower end of the body 48 is an engagement or locator tab 49, which functions to apply pressure to the T-bar from the opposite side of the T-bar than the locator tabs 70. This allows for equal pressure to the T-bar inhibiting deformation or weakening as the clip 40 is tightened.

Figure 7:
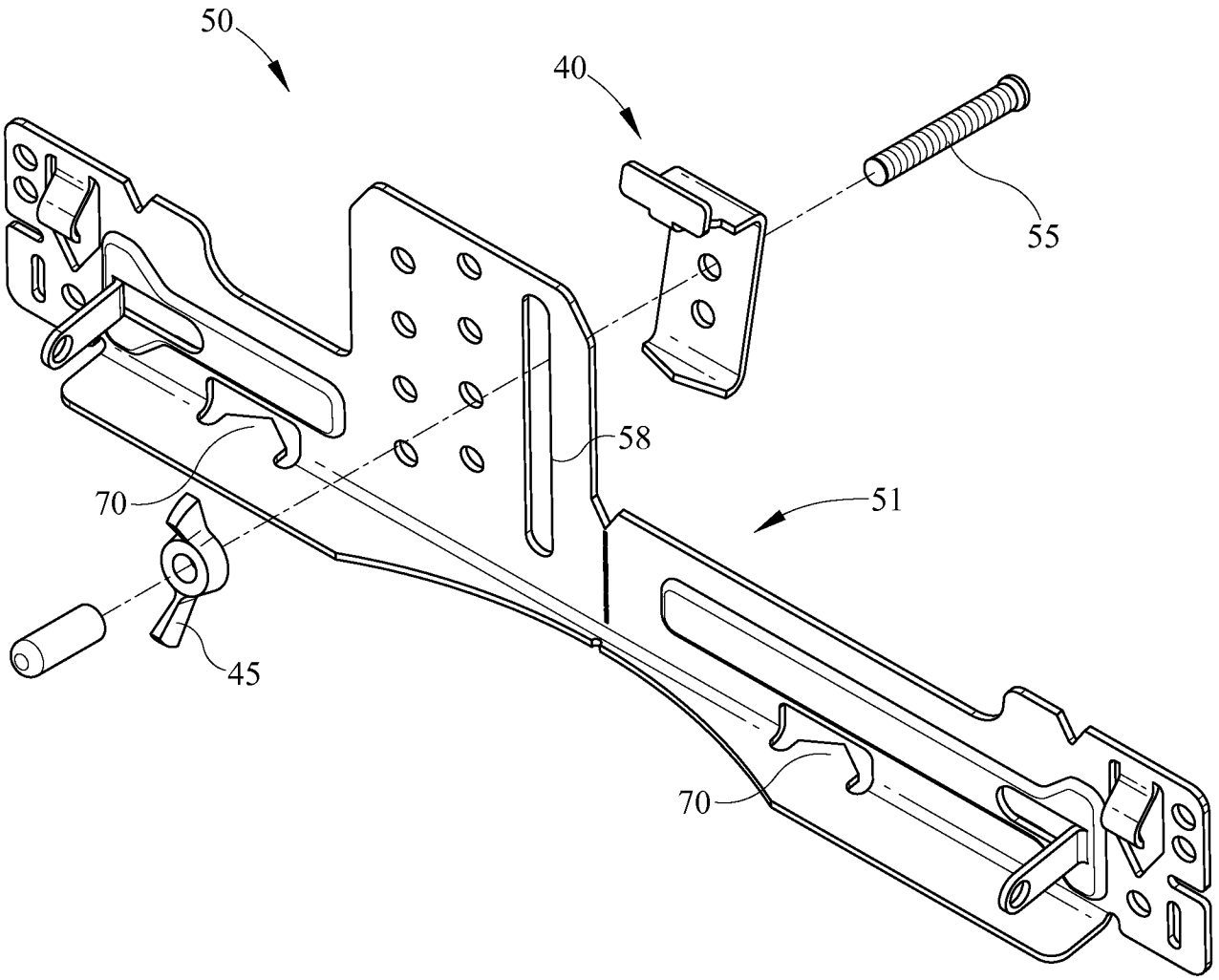
FIG. 7 is an exploded perspective view of the bracket assembly.

Referring now to FIG. 7, an exploded perspective view of the bracket assembly 50 is depicted. The bracket 51 is shown adjacent the clip 40. The fastener 55 is depicted connecting the clip 40 and the bracket 51. The clip 40 is positioned away from the bracket, however one skilled in the art will understand that the head must be rotated about 90 degrees to position the clip 40 through the slot 58. Once the head 42 is positioned through the slot 58, the clip 40 is rotated 90 degrees in the opposite direction so that the head is captured on one side of the bracket 51 while remaining portions of the clip 40 are disposed on the opposite side of the bracket 51. The fastener 55 is depicted extending through the clip 40 however, the fastener may be positioned on the opposite side of the bracket 51 with a wing nut 45 or other such hand-tightenable structure positioned against the clip 40. Further, the fastener 55 may be integrally formed with the clip 40 if so desired. With the clip 40 extending through the slot 58 and fastener 55 extending through the clip 40 and through the slot 58, the wing nut 45 is threadably attached to the fastener 55 so that the clip 40 is pulled toward the bracket 51 for tightening.

Figure 8:
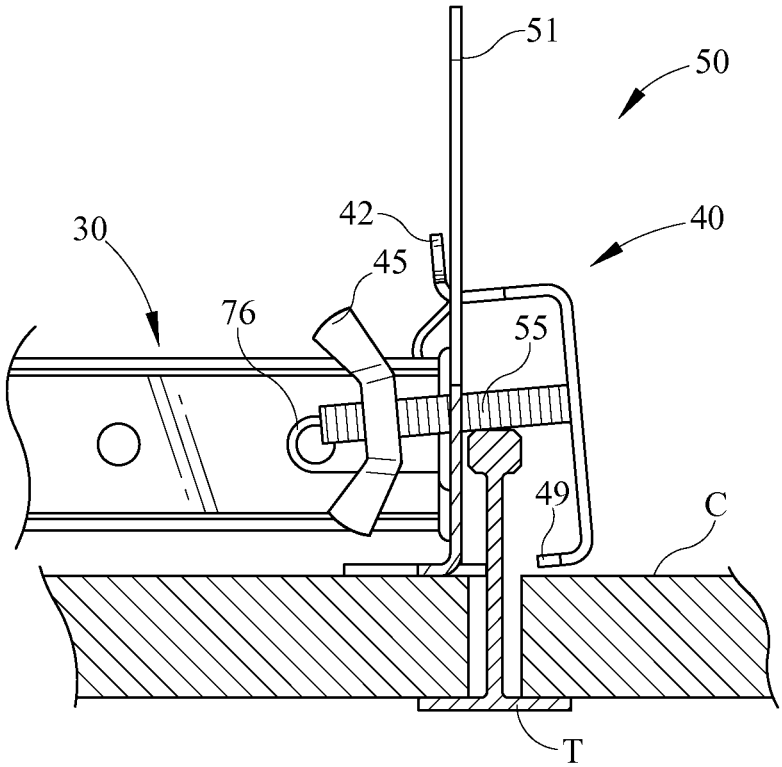
FIG. 8 is a first sequence of attaching the bracket assembly to a T-grid member.

Referring now to FIGS. 8 and 9, a side view of the bracket assembly 50 and hanger bar assembly 30 is shown before and after connection to a T-bar T and a ceiling tile C. The bracket 51 is shown with the clip 40 extending therethrough. Specifically, the head 42 of clip 40 is positioned on a first side of the bracket 51. The fastener 55 extends from the clip 40 through the bracket 51 to an end where the wing nut 45 is threadably positioned. As shown in FIG. 8, the wing nut 45 is not tightened so that a head of the T-bar T is received between the clip 40 and the bracket 51. Likewise, fastener 55 is resting against the head of the T-bar. The fastener 55, the clip 40 and bracket 51 bound an open space wherein the head of a T-bar T may be positioned, as shown in FIG. 9.

FIG. 9 shows engagement of the bracket assembly 50 and the T-bar T. The bracket 51 is positioned adjacent the T-bar T so that the head of the T-bar T is positioned within the space defined between the fastener 55, clip 40 and bracket 51. The clip 40, and more specifically the lower tab 49, is disposed over the head of the T-bar T. With the lower end tab 49 positioned over the head of the T-bar T, the wing nut 45 is tightened. Tightening the wing nut forces the clip 40 against the upper portion of T-bar T as well as the lower tab 70 against the T-bar T from a side opposite the end tab 49. This provides equal pressure on the T-bar which inhibits deformation of the structure and weakening of the T-bar grid. Further, as the nut 45 is tightened, the clip 40 pivots at the neck 44 and slot 58 contact point. With this pivoting, the tab 49 is pulled into the T-bar T frictionally engaging the T-bar. With this design, the bracket assemblies 50,52 receives T-bars of various height, width and style. This configuration provides one of three points of contact. The second and third points of contact are at the tabs 70. However other types of engagements are within the scope of the present embodiment.

Figure 10:
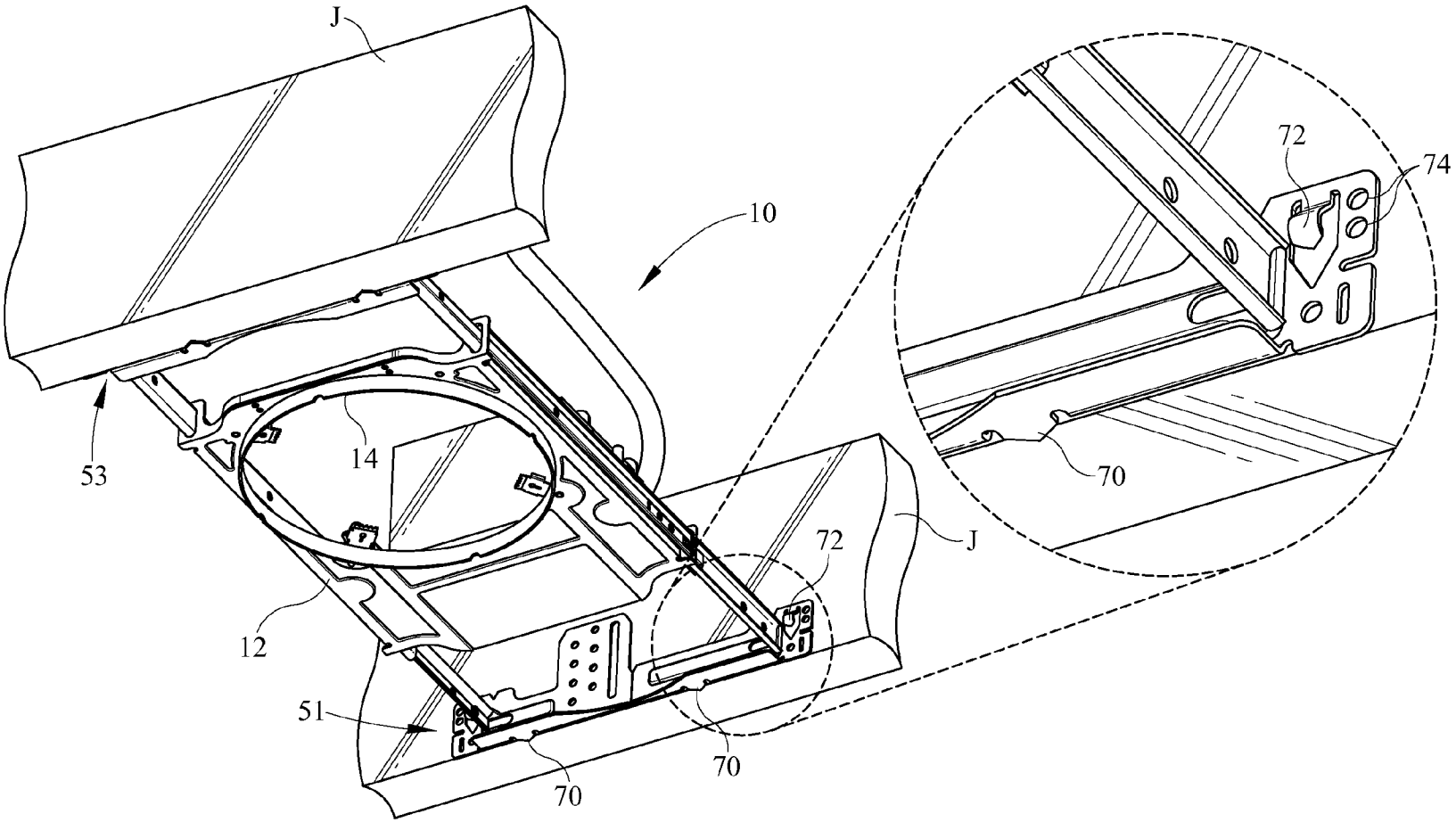
FIG. 10 is a perspective view of the device of FIG. 1 used with ceiling joists.

Referring now to FIG. 10, the device 10 is mounted between first and second ceiling joists J. The brackets 51, 53 are positioned against the joists for hammering of nailing tabs 72 and further fastening through apertures 74. Also shown are the locator tabs 70 disposed along the lower portion of the bracket 51 and extending from the foot 60. The upper surfaces of the locator tabs 70 are positioned against the lower surface of a ceiling joist J so that the frame 12 and aperture 14 are properly positioned relative to the ceiling (not shown) which extends across the joist structures J.

Figure 11:
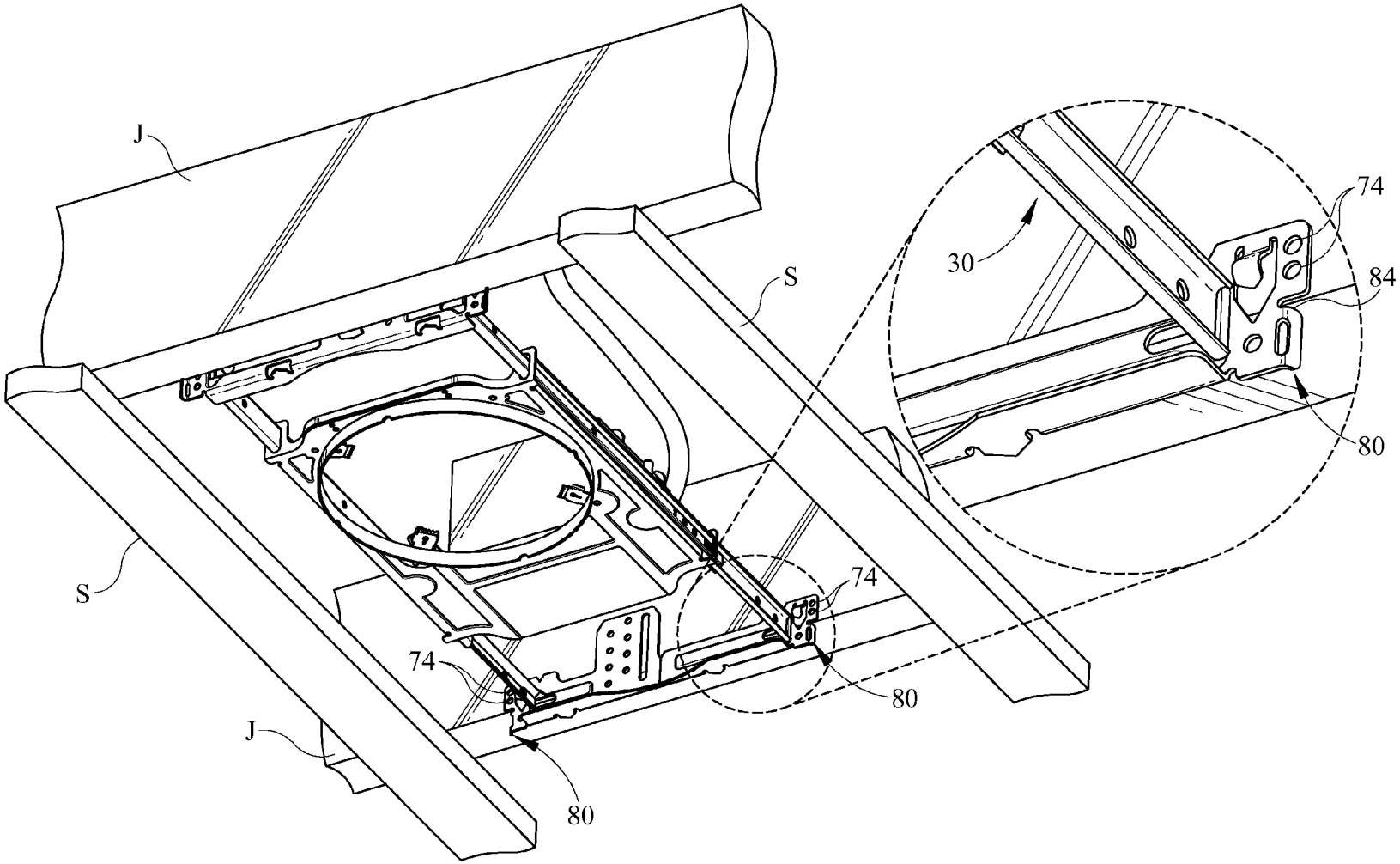
FIG. 11 is a perspective view of the device of FIG. 1 used with an alternative ceiling joist structure.

Referring now to FIG. 11, the device 10 is mounted between joist structures J as shown in FIG. 10. However, in the alternative embodiment shown, the joist structures J require strapping S extending from joist to joist as part of the structural requirements or building code. In this embodiment, the brackets utilize the joist tabs 80 in order to compensate for the thickness of the strap members S. As shown, the tabs 80 are integrally formed on the bracket 51 but may be otherwise movably formed thereon so that the upper edge 84 may be moved to engage the lower edge of the joist J. This lowers the elevation of the device 10 so that the position of the frame 12 compensates for the thickness of the straps S. Thus, the frame 12 is properly positioned relative to the ceiling (not shown) for installation of the recessed light. Once the tabs 80 are bent and properly positioned against the joist J, the nailing tabs 72 may be hammered and fasteners may be inserted through apertures 74.

Figure 12:
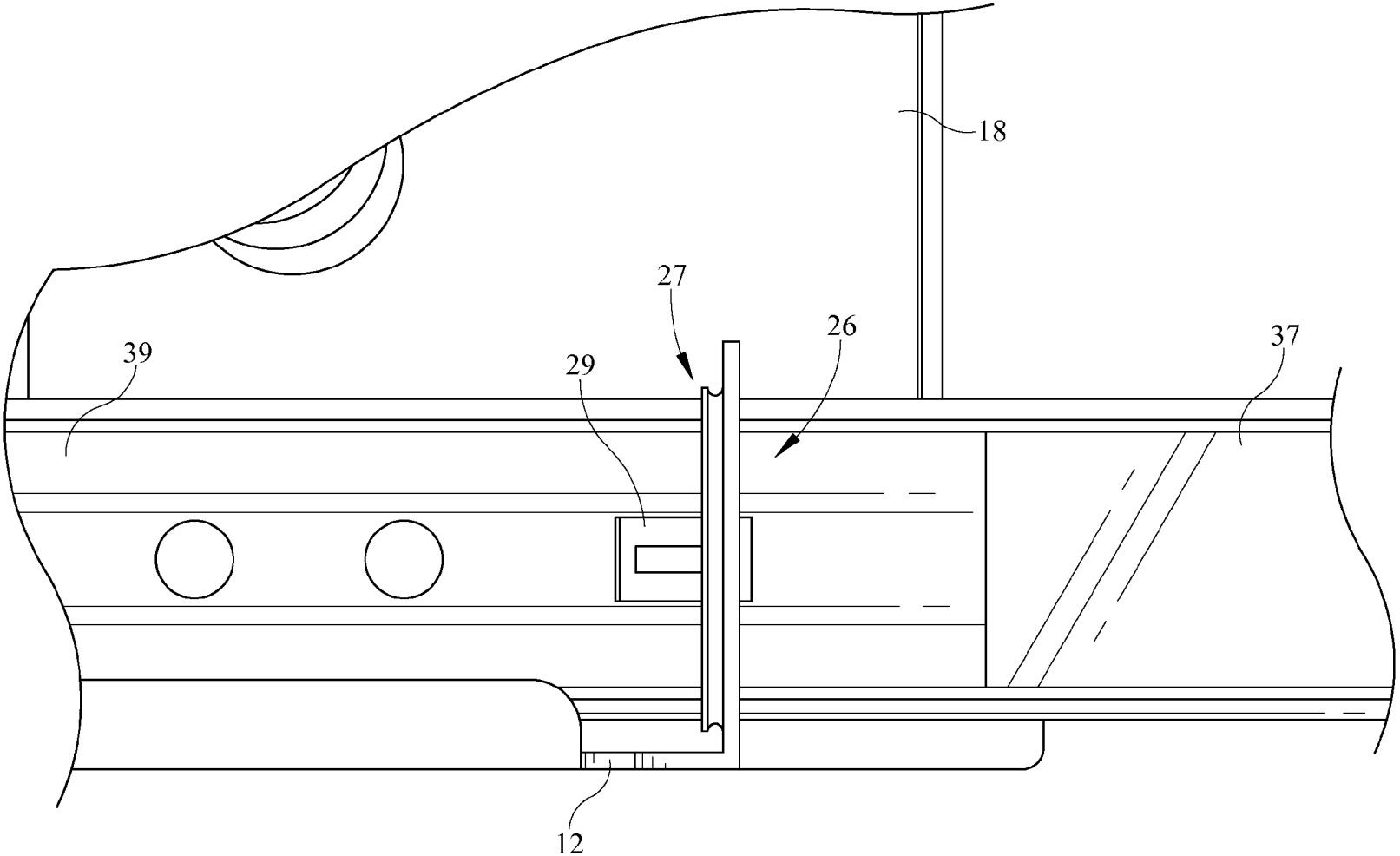
FIG. 12 is a side view of the fixture frame depicting a finger having a hanger bar assembly passing therethrough.

Referring now to FIG. 12, a side view of the frame 12 is depicted including the finger 26 extending upwardly from the frame. Extending from frame 12 is a junction box 18. Extending through the finger aperture 27 are hanger bars 37,39. The finger aperture 27 includes a rolled eyelet feature which inhibits the hanger bars 37,39 from catching on the aperture 27 edges defined at ends of the hanger bars 37,39. The rolled eyelets provide smooth sliding action of the hanger bar assemblies 37,39 relative to the fingers 26. In addition, due to the construction of the hanger bars 37,39 a discontinuous surface is formed where one hanger bar 37,39 slides into the other hanger bar 37,39. Accordingly, the rolled eyelet at aperture 27 provides a smooth surface which does not inhibit sliding of the bar assemblies 30,32 when moving through the aperture 27.

FIG. 12 also depicts an interference feature 29 which inhibits the bars 37,39 from slidably disengaging apart during installation. The interference feature 29 may include various dimples, tabs, or other engaging features which inhibits the bars 37,39 from sliding apart without being disengaged.

Figure 13:
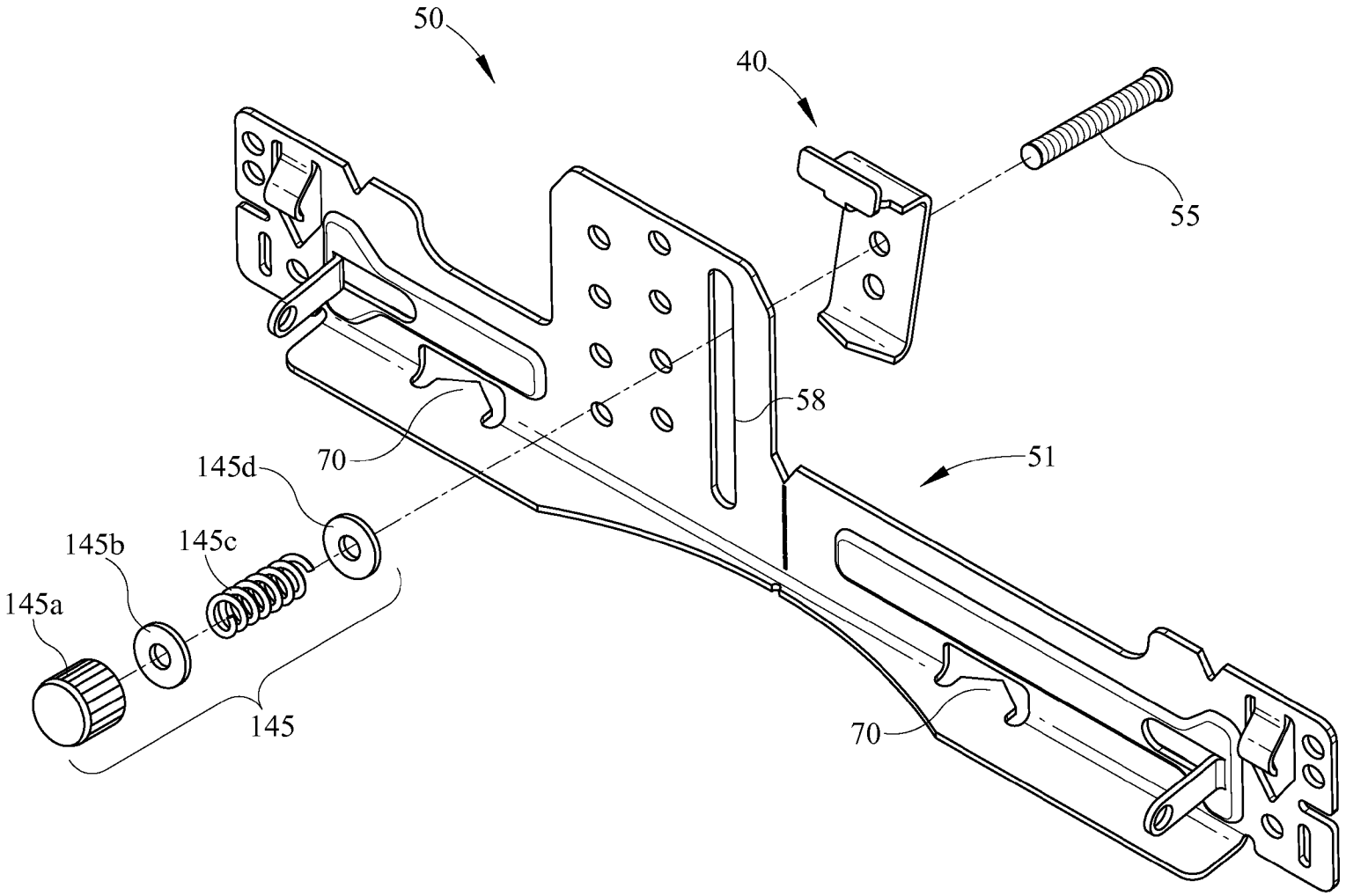
FIG. 13 is an alternative fastener assembly which is spring loaded.

Referring now to FIG. 13, an alternative fastening mechanism is provided. The bracket assembly 50 includes a bracket 51 and clip 40 as previously described. A fastener 55 extends through the clip 40, bracket slot 58 and bracket 51. A tightening assembly 145 is positioned on the opposite side of bracket 51. The assembly 145 comprises a knob 145*a* which may include a knurled surface, a biasing element 145*c* and at least one washer 145*b*. According to the exemplary design, the biasing element 145*c* is a compression spring although alternate biasing mechanisms maybe utilized. The spring is positioned between opposed washers 145*b* and 145*d*. The embodiment of FIG. 13 functions by biasing the clip 40 against the T-bar (not shown). However, when the knob 145*a* is depressed, opposite the spring force and against the bracket 51, spring force is released from the clip 40 allowing removal from the T-bar (not shown). Likewise, the knob 145*a* must be depressed to during installation to release spring pressure allowing the clip 40 to be located over the T-bar.

Figure 15:
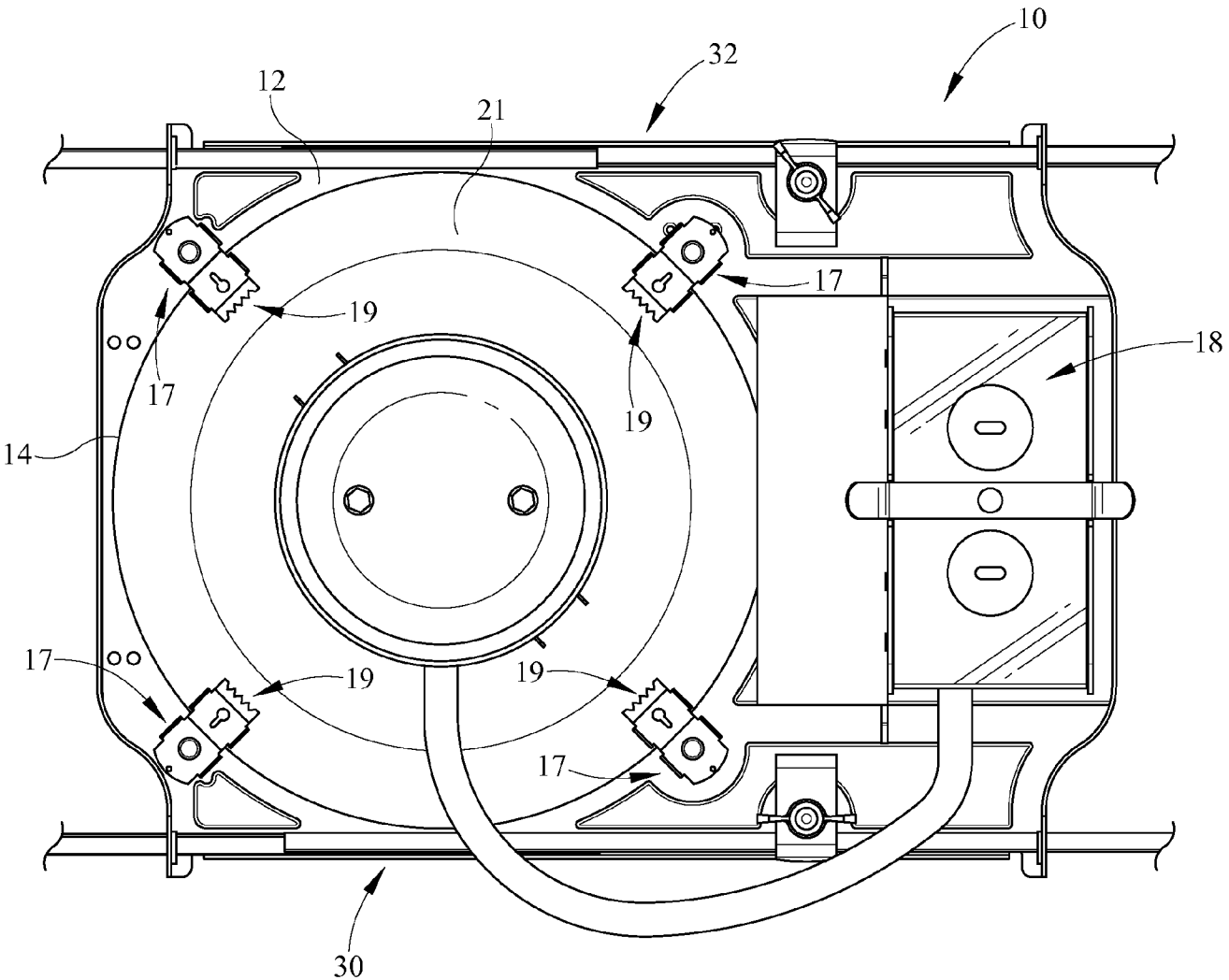
FIG. 15 is a top view of a mounting assembly with the trim engaged by the grips in a normally installed position.
Figure 16:
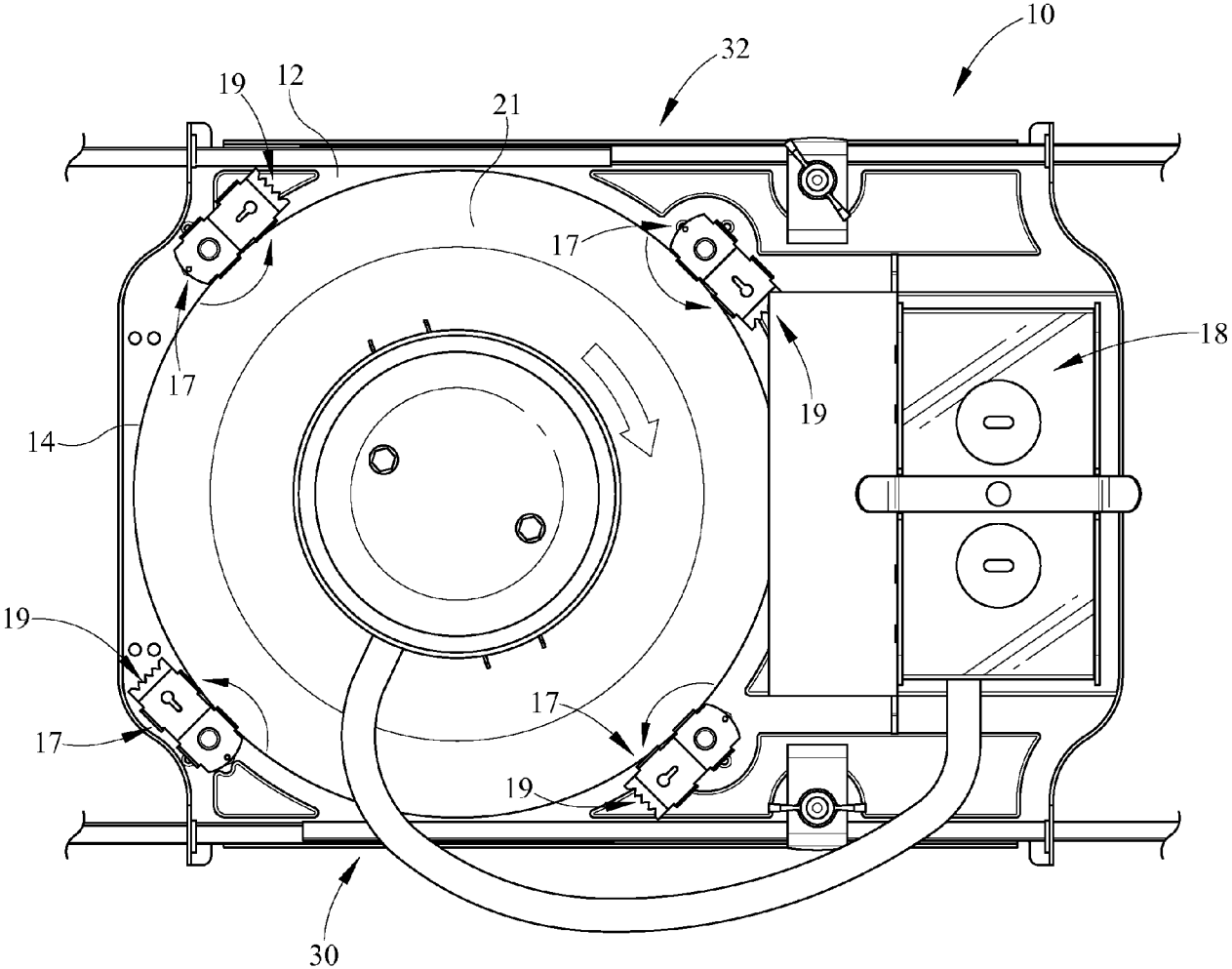
FIG. 16 is a top view of mounting assembly of FIG. 15, with the trim rotated for removal from the frame.

Referring now to FIGS. 15 and 16, the device 10 is shown in a top view. Within the frame 12 and aperture 14, is a reflector or trim 21. The trim member 21 may be formed of various materials as previously mentioned and in the exemplary embodiment is generally bell-shaped. The trim springs or grips 17 in clued at least one tooth or barb 19 at an end. In the exemplary embodiment, the trim springs 17 each include a plurality of teeth. The trim springs 17 are pivotally connected to the frame 12 and have a length allowing the beyond the peripheral edge defining aperture 14. More specifically, the springs 17 may be in the plane of the aperture 14 or above the plane of the aperture 14. With the trim springs 17 in a first position, the trim 21 is inserted upwardly through the aperture 14, the trim 21 engages the teeth 19 of the trim spring 17. Each trim spring 17 may be rigid or may be resilient to provide a force on the trim member 21 during the frictional engagement. Following installation, the trim springs 17 remain in the first position indicated in FIG. 15. Referring now to FIG. 16, the trim 21 is shown rotated for removal, as indicated by an arrow about the socket cup, for example during maintenance. Upon rotation of the trim 21, the frictional engagement of the trim 21 and the spring 17 causes the trim spring 17 to also rotate to a second position where the teeth 19 are no longer engaging the trim member 21. With the trim springs 17 disengaged from the trim 21, the reflector or trim 21 may be lowered through the aperture 14 and through the ceiling providing access for maintenance.

The foregoing description of methods and embodiments of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A T-bar mounting system for a luminaire, comprising:
a fixture frame for a luminaire;
hanger bars connected to said frame for connection of said frame to a suspended ceiling grid;
a bracket connecting ends of said hanger bars;
said bracket having an upwardly extending portion with an adjustment aperture therein;
a clip releasably connected to said bracket for slidable adjustment through said adjustment aperture; and
a fastener extending through said clip and said bracket for releasable adjustment of said clip,
wherein said bracket is positionable against an upper surface of a suspended ceiling tile and said clip is positionable against an upper portion of said suspended ceiling grid,
wherein said clip has a body portion in a first plan and a head portion in a second plane different from the first plane, the head portion extending away from the body portion and being connected to the body portion through a neck portion, and
wherein the head portion is configured to pass through said adjustment aperture for being positioned at a first side of the bracket while the body portion remain at a second side of the bracket opposite the first side.

2. The T-bar mounting system of claim 1, said clip having a contact tab bearing against said suspended ceiling grid.

3. The T-bar mounting system of claim 2, said bracket having a locator tab for engagement of said suspended ceiling grid.

4. The T-bar mounting system of claim 1, said bracket having a foot, said foot inhibiting ceiling tile float.

5. The T-bar mounting system of claim 1, wherein the first plane is parallel to the second plane.

6. The T-bar mounting system of claim 1, wherein the fastener extends through a hole in the body portion of the clip and through said adjustment aperture of said bracket.

7. A T-bar mounting bracket assembly for a luminaire fixture frame, comprising:
a bracket;
a clip vertically adjustable relative to said bracket, said clip having a head portion extending through an opening in said bracket, the head portion being in a plane different than a plane of a body portion of the clip, a neck portion of the clip connecting the head portion to the body portion, wherein the head portion is configured to pass through said opening for being positioned at a first side of the bracket while the body portion remain at a second side of the bracket opposite the first side; and
a fastener extending through said bracket and said clip;
said fastener spaced from a location where said clip passes through said opening.

8. The T-bar mounting bracket assembly of claim 7 further comprising a space between said fastener and a lower portion of said clip for receiving a T-bar.

9. The T-bar mounting assembly of claim 7, said clip having a neck extending through said opening.

10. The T-bar mounting assembly of claim 9 further comprising locator tabs extending from said bracket.

11. The T-bar mounting bracket assembly of claim 10 further comprising locator tabs extending from said bracket.

12. The T-bar mounting bracket assembly of claim 11 said clip and said bracket having three points of contact with a T-bar grid member.

13. The T-bar mounting assembly of claim 7 wherein tightening of said fastener causes said clip to wedge against said bracket.

14. A T-bar mounting bracket assembly for a luminaire fixture frame, comprising:
a bracket;
a clip vertically adjustable relative to said bracket, said clip having a head portion extending through an opening in said bracket, the head portion being in a plane different than a plane of a body portion of the clip, a neck portion of the clip connecting the head portion to the body portion, wherein the head portion is configured to pass through said opening for being positioned at a first side of the bracket while the body portion remain at a second side of the bracket opposite the first side; and
a fastener extending through said bracket and said clip;
said bracket having a foot inhibiting ceiling tile float.

15. A suspended ceiling mounting assembly for a luminaire, comprising:
a bracket extending from a first hanger bar to a second hanger bar;
a slot extending through said bracket;
a clip adjustable through said slot; and,
a fastener engaging said slot and said clip;
wherein a suspended ceiling member is captured between said bracket, said clip and said fastener;
wherein said bracket engages a suspended ceiling tile.

16. The suspended ceiling mounting assembly of claim 15, said clip and said bracket defining three points of contact with a suspended ceiling member.

17. The suspended ceiling mounting assembly of claim 15 further comprising a hand tightenable nut.

18. The suspended ceiling mounting assembly of claim 17, said nut being a wing nut.

19. The suspended ceiling mounting assembly of claim 15 further comprising a knob, said knob being spring loaded.

20. The suspended ceiling mounting assembly of claim 15, said assembly allowing a tool-less installation between said bracket, said clip and a suspended ceiling member.

21. The suspended ceiling mounting assembly of claim 15 further comprising a foot extending from said bracket for inhibiting ceiling tile float.

22. A suspended ceiling mounting assembly for a luminaire, comprising:

a first U-shaped sub-assembly comprising a first bracket, a first hanger bar, and a second hanger bar;

a second U-shaped sub-assembly comprising a second bracket, a third hanger bar and a fourth hanger bar;

a fixture frame disposed between said first U-shaped sub-assembly and said second U-shaped sub-assembly;

a clip vertically adjustable relative to said first bracket, said clip having a head portion extending through an opening in said first bracket, the head portion being in a plane different than a plan of a body portion of the clip, a neck portion of the clip connecting the head portion to the body portion, wherein the head portion is configured to pass through said opening for being positioned at a first side of the first bracket while the body portion remain at a second side of the first bracket opposite the first side, said first U-shaped sub-assembly slidably connected to said second U-shaped sub-assembly and capturing said fixture frame there between.

23. The suspended ceiling mounting assembly of claim 22 further comprising an interference feature disposed between said first hanger bar and said third hanger bar for inhibiting said first U-shaped sub-assembly and said second U-shaped sub-assembly from disengaging.

24. The suspended ceiling mounting assembly of claim 22 further comprising a clip slidably positioned on each of said first bracket and said second bracket, said clip receiving a T-bar between each of said clip and said first and second brackets.

25. The suspended ceiling mounting assembly of claim 24, said clip being a hand tightenable nut.

26. The suspended ceiling mounting assembly of claim 24 further comprising a releasably biased knob.

27. A recessed light mounting assembly for a luminaire, comprising:

a first bracket assembly and a second bracket assembly;

a first hanger bar assembly and a second hanger bar assembly connecting said first and second bracket assemblies;

a clip vertically adjustable relative to said first bracket assembly, said clip having a head portion extending through an opening in said first bracket assembly, the head portion being in a plane different than a plan of a body portion of the clip, a neck portion of the clip connecting the head portion to the body portion, wherein the head portion is configured to pass through said opening for being positioned at a first side of the first bracket assembly while the body portion remain at a second side of the first bracket assembly opposite the first side, said first hanger bar assembly having a single connection to a T-bar grid;

said second hanger bar assembly having a single connection to said T-bar grid.

28. A recessed light mounting assembly luminaire, comprising:

a first bracket assembly and a second bracket assembly;

a first hanger bar assembly and a second hanger bar assembly;

said first and second hanger bar assemblies slidably connecting said first and second bracket assemblies;

a frame slidably positioned on said first and second hanger bar assemblies between said first bracket assembly and said second bracket assembly; and a clip vertically adjustable relative to said first bracket assembly, said clip having a head portion extending through an opening in said first bracket assembly, the head portion being in a plane different than a plan of a body portion of the clip, a neck portion of the clip connecting the head portion to the body portion, wherein the head portion is configured to pass through said opening for being positioned at a first side of the first bracket assembly while the body portion remain at a second side of the first bracket assembly opposite the first side, wherein said recessed light mounting assembly is connected to a T-bar grid at a first location by said first bracket assembly and at a second location by said second bracket assembly only.

* * * * *